United States Patent [19]

Trask

[11] Patent Number: 4,843,838

[45] Date of Patent: Jul. 4, 1989

[54] AIR-TO-AIR HEAT PUMP

[76] Inventor: Allen Trask, 8400 Vamo Rd., Sarasota, Fla. 34231

[21] Appl. No.: 137,164

[22] Filed: Dec. 23, 1987

[51] Int. Cl.[4] ..... F25B 13/00

[52] U.S. Cl. ..... 62/324.6; 62/155; 62/218

[58] Field of Search ..... 62/160, 218, 324.6, 62/155

[56] References Cited

U.S. PATENT DOCUMENTS

| | | | |
|---|---|---|---|
| 2,051,802 | 8/1936 | Philipp | 62/218 X |
| 3,170,304 | 2/1965 | Hale | 62/155 |
| 3,273,635 | 9/1966 | Jobes | 62/155 X |

FOREIGN PATENT DOCUMENTS

| | | | |
|---|---|---|---|
| 137827 | 6/1934 | Austria | 62/218 |
| 0153985 | 9/1982 | Japan | 62/324.6 |

*Primary Examiner*—Harry B. Tanner

*Attorney, Agent, or Firm*—Charles S. McGuire

[57] ABSTRACT

An air-to-air heat pump with improved efficiency of operation, and simplicity and economy of construction. Initiation and termination of defrost cycles during heating mode operation is controlled, in addition to the conventional clock timer, by a dual pressure switch responsive to pressure in the outdoor coil, thereby significantly reducing the length of defrost cycles with corresponding improvement in operating efficiency. The direction of refrigerant flow between the indoor and outdoor coils is established in a first line through the compressor by an electrically operated reversing valve, and alternatively through second and third lines, depending upon whether the system is operating in the heating or cooling mode, by series-connected check and float valves in each of such lines. When heating mode operation is resumed following a defrost cycle, the float valve has delivered all liquid-refrigerant to the indoor coil. Since there is no liquid refrigerant in the outdoor coil to be drawn into the compressor under these conditions, the usual trap type accumulator is not required and is therefore eliminated in the present system.

15 Claims, 3 Drawing Sheets

AIR-TO-AIR HEAT PUMP

BACKGROUND OF THE INVENTION

The present invention relates to air-to-air heat pumps, and more specifically to improved refrigeration circuits for controlling operation of such heat pumps.

Conventional heat pumps include a refrigeration circuit with a compressor and indoor and outdoor heat exchanger coils which function alternately as a condenser and an evaporator in response to a thermostat controlled valve reversing the direction of refrigerant flow between heating a cooling cycles. During cooling cycles the indoor coil functions as an evaporator, absorbing heat from indoor air, and the outdoor coil functions as a condenser, rejecting heat into the outdoor air. Conversely, during heating cycles the outdoor and indoor coils function as evaporator and condenser, respectively, absorbing heat from outdoor air and rejecting heat to indoor air for comfort heating.

The outdoor coil and associated heat exchange fins are subject to collection of frost and/or snow when weather conditions so dictate. This results, of course, in reducing heat transfer by blocking air flow through the fins, and by its insulating effect on the fin and coil surfaces. Frost and/or snow is periodically removed by switching the system to operate temporarily in the cooling mode, causing the higher temperature refrigerant to flow to the outdoor coil, raising the temperature thereof sufficiently to melt the frozen or crystallized moisture. Such temporary cooling or defrost cycles are commonly initiated by means responsive to the thickness of frost, snow or ice buildup, in cooperation with timer means.

During defrosting cycles condensed refrigerant is delivered from the outdoor coil to the indoor coil through the cooling capillary tube sized for optimum refrigerant flow under the high condensing pressure of cooling cycles. Under the reduced condensing pressure of defrost cycles the refrigerant flow is restricted by the capillary tube to a flow volume less than the rate of condensation in the outdoor coil. Therefore the system liquid refrigerant is collected in the outdoor coil leaving the indoor coil dry. The compressor continues running while its suction pressure reduces the pressure in the indoor coil to less than zero.

The defrost cycle is terminated, and heating cycle resumed, in conventional systems, in response to the opening of thermostat contacts when the frost, etc. has been removed, or at the end of a predetermined time period. The resulting sudden delivery to the compressor crankcase of liquid refrigerant which has been expanded in the indoor coil, then condensed and retained in the outdoor coil during the defrost cycle, would be damaging to the compressor mechanism if suddenly returned to the indoor coil at the beginning of a heating cycle. The conventional approach to guarding against such potential damage is to install a trap-type accumulator between the reversing valve and the compressor suction port for collecting the surge of liquid refrigerant, and gradually releasing it into the compressor crankcase at a safe, metered rate.

The use of a trap-type accumulator, while considered necessary for protection of the compressor, is generally recognized to have a number of disadvantages. These disadvantages are enumerated in applicant's prior U.S. Pat. No. 4,266,405, which discloses an improved heat pump refrigeration circuit which bypasses the accumulator during cooling and defrost cycles. However, the accumulator is still required, and refrigerant flows therethrough during normal heating cycles. This adds to the cost and detracts from the efficiency and potential capabilities of the heat pump system.

Accordingly, it is a principal object of the present invention to provide an air-to-air heat pump which operates efficiently and without danger of damage to operating components, yet does not include an accumulator.

Another object is to provide a heat pump system wherein defrost cycles are initiated and terminated by means independent of conventional thermostat control.

A further object is to provide means for minimizing the time length and maximizing the dependability of control of defrost cycles in air-to-air heat pump systems.

In a more general sense, the object of the invention is to provide an air-to-air heat pump with improved heat gain during cold weather, to the extent of replacing combustion heating at average temperatures in all climates, and automatically adding supplementary electric heating during periods of abnormally low temperature.

Other objects will in part be obvious and will in part appear hereinafter.

SUMMARY OF THE INVENTION

In accordance with the foregoing objects, the invention contemplates an air-to-air heat pump system wherein indoor and outdoor coils are connected by a refrigerant line passing through a compressor and a reversing valve to control the direction of flow of refrigerant between the coils. Refrigerant flows in the usual manner from indoor to outdoor coil when the system is operating in the cooling or defrost modes, and from outdoor to indoor when operating in the heating mode. However, the refrigerant line does not include the usual trap-type accumulator normally provided in such systems.

In addition to the refrigerant flow line through the compressor and reversing valve, the indoor and outdoor coils are connected by a pair of parallel lines, each including a float valve and a one-way check valve connected in series. Refrigerant flows through one of the parallel lines from the outdoor to the indoor coil during operation in the cooling and defrosting modes, i.e., when the reversing valve is positioned for flow of refrigerant through the compressor and reversing valve from indoor to outdoor coil. During operation in the heating mode, refrigerant flows in the opposite direction, i.e., from indoor to outdoor coil, through the other parallel line.

The float valves are constructed to operate in two phases, dependent upon the level of liquid refrigerant inside the movable float device. A piston for opening and closing a stationary valve at the lower end of the refrigerant outlet line is carried by and movable with the float device. In one phase of operation, liquid refrigerant flows into the float device, moving it downwardly to fully open the valve and permit liquid refrigerant to flow freely through the outlet tube. When the liquid level in the float device has dropped, as liquid refrigerant is drained from the indoor coil during heating cycles faster than refrigerant vapor supplied by the compressor has been condensed, the float device moves upwardly, raising the piston toward the valve seat. Fluid flow is then modulated during the other phase of operation through variation in buoyancy of the float device to the flow rate of condensed vapor supplied by the compressor. Since the outlet tube opening at the valve seat is always submerged, vapor is prevented from passing through the float valve while the outdoor coil is continually kept drained.

Initiation and duration of defrosting cycles of the heat pump system are controlled by a dual pressure switch responsive to pressure in the outdoor coil, and a clock timer. The pressure values at which opening and closing of the pressure switch contacts occur are separately adjustable, whereby the switch operates at the outdoor coil pressures, and corresponding refrigerant temperatures, selected for initiating and terminating defrost cycles. The clock timer is set at the desired duration of heating cycles, e.g., 90 minutes, and a defrost cycle is initiated when the contacts are closed on both the pressure switch and the timer.

The adverse effects on heating efficiency of the system during the time length of defrost cycles are inherently doubled. Not only is heating time lost, but additional heat is lost from the conditioned enclosure at the normal rate of heat gain when the system is operating in the heating mode. For this reason, the pressure switch settings are critical in minimizing the time length of defrost cycles. The control circuit ideally should initiate a defrost cycle when weather conditions are such as to induce collection of frost on the outdoor coil, and terminate the cycle immediately when outdoor coil temperature assures elimination of frost which may have accumulated. Examples of desired settings of the dual pressure switch to provide the desired operation with a particular refrigerant will be discussed in the following detailed description.

BRIEF DESCRIPTION OF THE DRAWINGS

FIG. 1. a typical prior art design, FIG. 2. the prior art design of applicant's prior patent, FIG. 3. the system of the present invention operating in the cooling or defrosting mode, and FIG. 4. the system of the present invention operating in the heating mode.

DESCRIPTION OF THE PREFERRED EMBODIMENT

Figure 1:
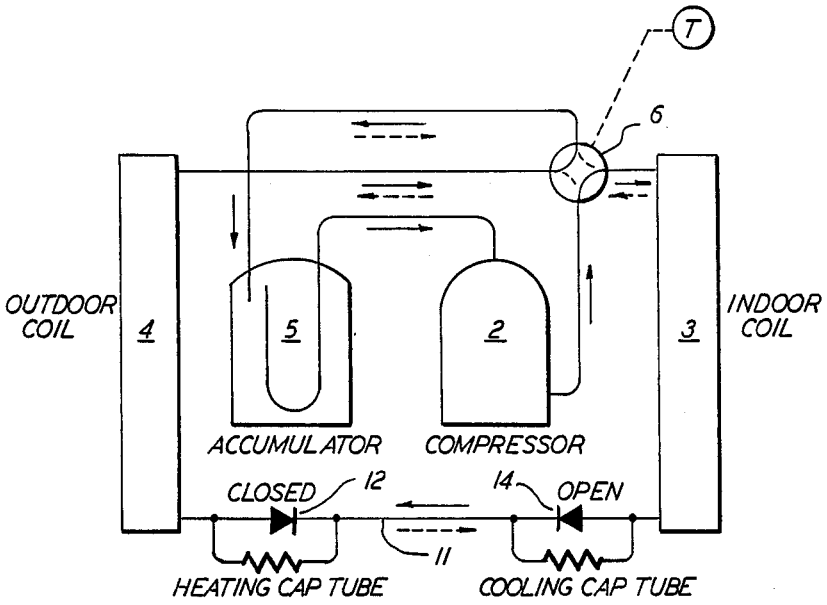
FIG. 1 Prior Art
FIGS. 1–4 are diagrammatic illustrations of the following air-to-air heat pump systems.

Referring now to the drawings, in FIG. 1 is shown a prior art, air-to-air heat pump refrigeration circuit showing the typical manner of connection of a trap-type accumulator in the system. This circuit comprises compressor 2, indoor and outdoor coils 3 and 4, respectively, and accumulator 5, connected by refrigerant flow lines through reversing valve 6. Solid line arrows placed next to the refrigerant flow lines indicate the direction of flow when the system is operating in the heating mode, i.e., with indoor coil 3 acting as a condenser and outdoor coil 4 as an evaporator. The heat exchange coils are also connected by line 11, which includes check valves 12 and 14, each bypassed by a capillary tube for flow of refrigerant at controlled pressure when the associated check valve is closed.

The position of reversing valve 6 is controlled by a solenoid responsive to indoor thermostat, diagrammatically indicated at T, for changing the coil inlet lines to which the outlet of compressor 2 is directly connected. When valve 6 is rotated 90° from the position shown in FIG. 1, the functions of the coils are reversed, with indoor coil 3 acting an an evaporator and outdoor coil 4 as a condenser. While operating in the heating mode, outdoor weather conditions sometimes cause frost to accumulate on the outdoor coil and fins. In order to remove all or some of the frost, thereby restoring the efficiency of heat transfer from the surrounding air to the coil, the system is temporarily switched from the heating to the cooling mode. This temporary operation in the cooling mode transfers hot refrigerant vapor from the indoor coil to the outdoor coil to melt frost thereon and is referred to as a defrost cycle.

A distinctive feature of this conventional heat pump circuit is the permanent connection of accumulator 5 upstream of the suction port of compressor 2 in both heating and cooling modes of operation. The disadvantages of locating the accumulator in the circuit where it intercepts hot gas from the indoor coil before delivering it to the outdoor coil for defrosting are addressed in previously mentioned U.S. Pat. No. 4,266,405, which provides an alternative refrigerant circuit.

Figure 2:
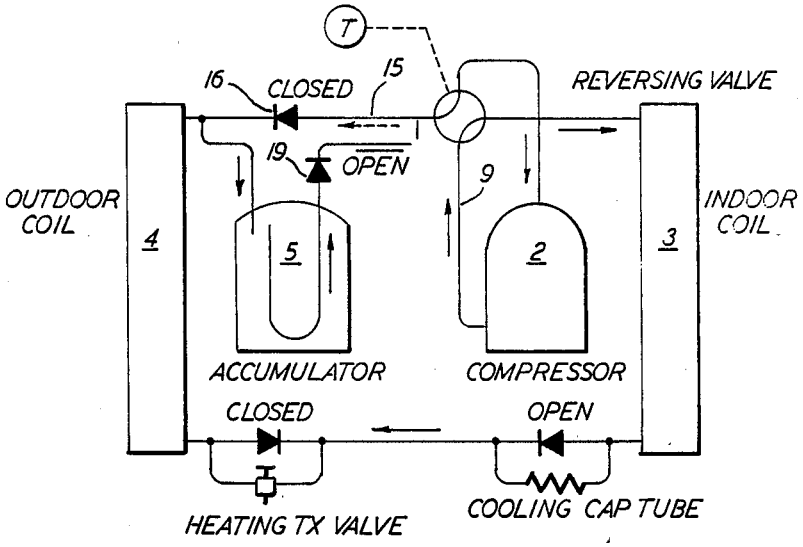
FIG. 2 Prior Art

The circuit shown in FIG. 2 is one embodiment of the heat pump system of the prior patent. Common reference numerals are used in FIG. 2 for elements corresponding to those of FIG. 1. The position of reversing valve 6 and arrows in FIG. 2 also indicate the direction of refrigerant flow when the system is operating in the heating mode. Without repeating the step-by-step operation of the system, it will be seen that the purpose and function of the accumulator is the same as in the system of FIG. 1. However, during cooling (and thus defrosting) operation, check valve 19 is closed so that hot gas from compressor 2 flows through lines 9 and 15 and check valve 16 directly to outdoor coil 4, and is not intercepted by accumulator 5.

While the system of FIG. 2 is superior to that of FIG. 1 in improving efficiency and reducing the time of defrost cycles, the trap-type accumulator is still required to protect against potential damage to compressor components when switching from cooling to heating modes. Also, the system depends upon a frost sensing device, or the like, in order to initiate defrost cycles. As will now be explained, the present invention provides a heat pump system which does not require either an accumulator or a frost sensing device, thereby improving the operating characteristics of the system to an extent and in respects not previously possible.

Figure 4:
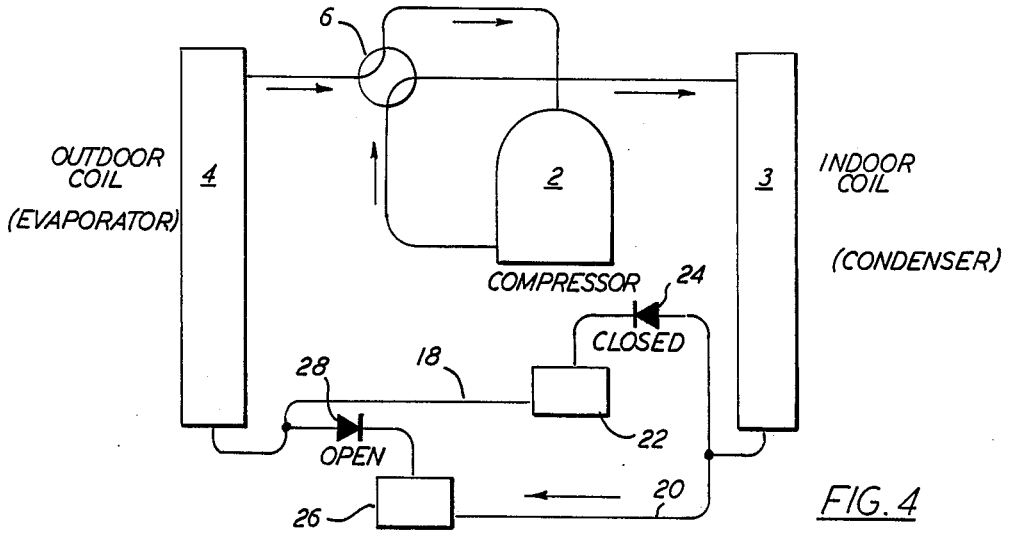
Figure 3:
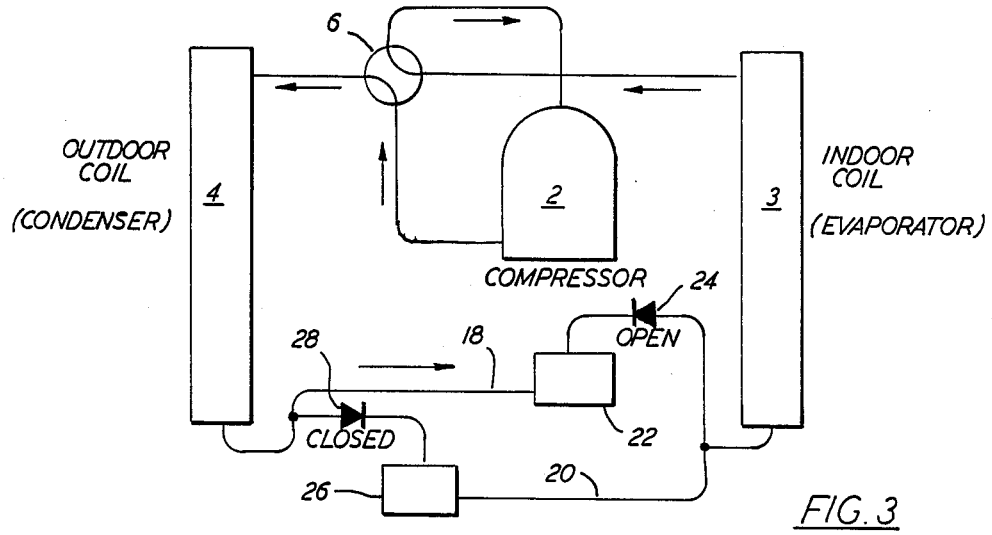

Referring now to FIG. 3, the air-to-air heat pump circuit of the present invention includes compressor 2, indoor and outdoor coils 3 and 4, and reversing valve 6 positioned in the refrigerant flow lines to reverse the coil to which refrigerant flows from the compressor. The reversing valve is shown in FIG. 4 as positioned during heating mode operation, as in FIGS. 1 and 2, with refrigerant flowing from outdoor coil 4, through valve 6, to compressor 2, and again through valve 6 to indoor coil 3. Valve 6 is shown in FIG. 3 in the opposite position, for refrigerant flow from indoor coil 3, through valve 6 to compressor 2, and again through valve 6 to outdoor coil 4, for operation in the cooling mode and during defrost cycles. When the system is operating in the heating mode, the indoor coil acts as a condenser and the outdoor coil as an evaporator; the action is the opposite during cooling and defrosting operation.

Coils 3 and 4 are also connected by two, parallel connected refrigerant flow lines 18 and 20. Line 18 includes float valve 22 and check valve 24, and line 20 includes float valve 26 and check valve 28. The float and check valves of each line are connected in series, check valve 24 (open during cooling cycles) being positioned between indoor coil 3 and float valve 22 in line 18, and check valve 28 (open during heating cycles) between outdoor coil 4 and float valve 26 in line 20. Float valves 22 and 26 are identical in construction, as are check valves 24 and 28.

Figure 5:
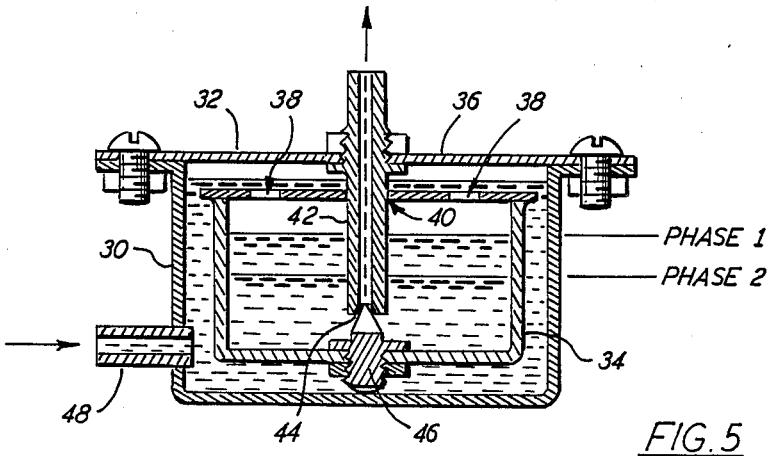
FIG. 5 is a front elevational view, in full section through the center, of a float valve forming part of the heat pump system of the invention.

Although conventional, commercially available check valves may be used, a construction of float valves 22 and 26 providing the desired operation, is shown in FIG. 5. Housing 30 and cover 32 provide an enclosure for cup-like float device 34, having cover 36 with one or more openings 38 for flow of liquid refrigerant from housing 30 into the interior of float device 34. As an alternative to a full cover with openings therein, a strap may extend across the otherwise open top of the cup. Cover 36 (or the alternate strap) has a central opening 40 loosely surrounding outlet tube 42 which extends downwardly through opening 40 to a lower end defining a valve seat 44 within float device 34. Outlet tube 42 also extends through an opening in housing cover 32, to which it is fixedly connected.

Refrigerant flows into housing 30 through inlet tube 48; the inlet tubes of float valves 22 and 26 are connected to, or form part of, lines 18 and 20, respectively (FIGS. 3 and 4). The portion of outlet tube 42 above housing cover 32 is connected to, or forms part of, line 18 or 20 in which the respective float valve is connected. Piston 46 is fixedly attached to the lower, central portion of float device 34 and moves therewith between open and closed positions with respect to stationary valve seat 44. Opening 40 and tube 42 cooperate to form a guide for vertical movement of float device 34. Piston 46 extends through float device 34 and contacts the lower, inside surface of housing 30 in the lowest position of float device 34.

During operation of the heat pump in the heating mode (FIG. 4), condensed refrigerant flows through line 20 from indoor coil 3 into float valve 26. As housing 30 of this valve fills with refrigerant, float device 34 rises, reducing the valve opening formed by seat 44 and piston 46. The elements of float valves 22 and 26 are so constructed and arranged that when float device 34 is in its uppermost position, i.e., with piston 46 fully engaged with valve seat 44, there is a space between the upper surface of float device cover 36 and housing cover 32. Thus, when the refrigerant level within housing 30 rises above cover 36, refrigerant flows through openings 38 into the interior of float device 34, rising to the level indicated as Phase 1 in FIG. 5. This causes float device 34 to sink within the liquid refrigerant filling the annular space between housing 30 and float device 34. Downward movement of float device 34 causes the valve to open, allowing liquid refrigerant to flow out through tube 42 and open check valve 28 in series therewith, into outdoor coil 4, resulting in lowering the level of refrigerant in float device 34 to the level indicated as Phase 2.

When the evaporator (outdoor coil 4) is filled with the available system charge of liquid refrigerant, the vapor flow to the condenser (indoor coil 3) is reduced to a liquid flow volume equal to the flow rate of vapor delivered by the compressor to coil 3 and condensed therein. The reduced flow rate and removal of refrigerant from float valve 26 causes float device 34 thereof to rise, again moving piston 46 toward the closed position with respect to seat 44, whereby the valve opening is reduced as required to modulate refrigerant flow therethrough automatically at the rate of condensation within coil 3. Vapor is automatically prevented from passing through float valve 26 since the buoyancy of float device 34 will close the valve while the lower end of outlet tube 42 is still submerged.

When the system operates in the cooling or defrosting (temporary cooling) mode, shown in FIG. 3, the operation is the same, with liquid refrigerant flowing from coil 4 into float valve 22, and thence through check valve 24 to indoor coil 3. The operation of the float valve delivers liquid refrigerant to coil 3 immediately after its condensation to prevent accumulation of liquid refrigerant in outdoor coil 4, thereby eliminating the need for the accumulator shown in FIGS. 1 and 2.

Figure 6:
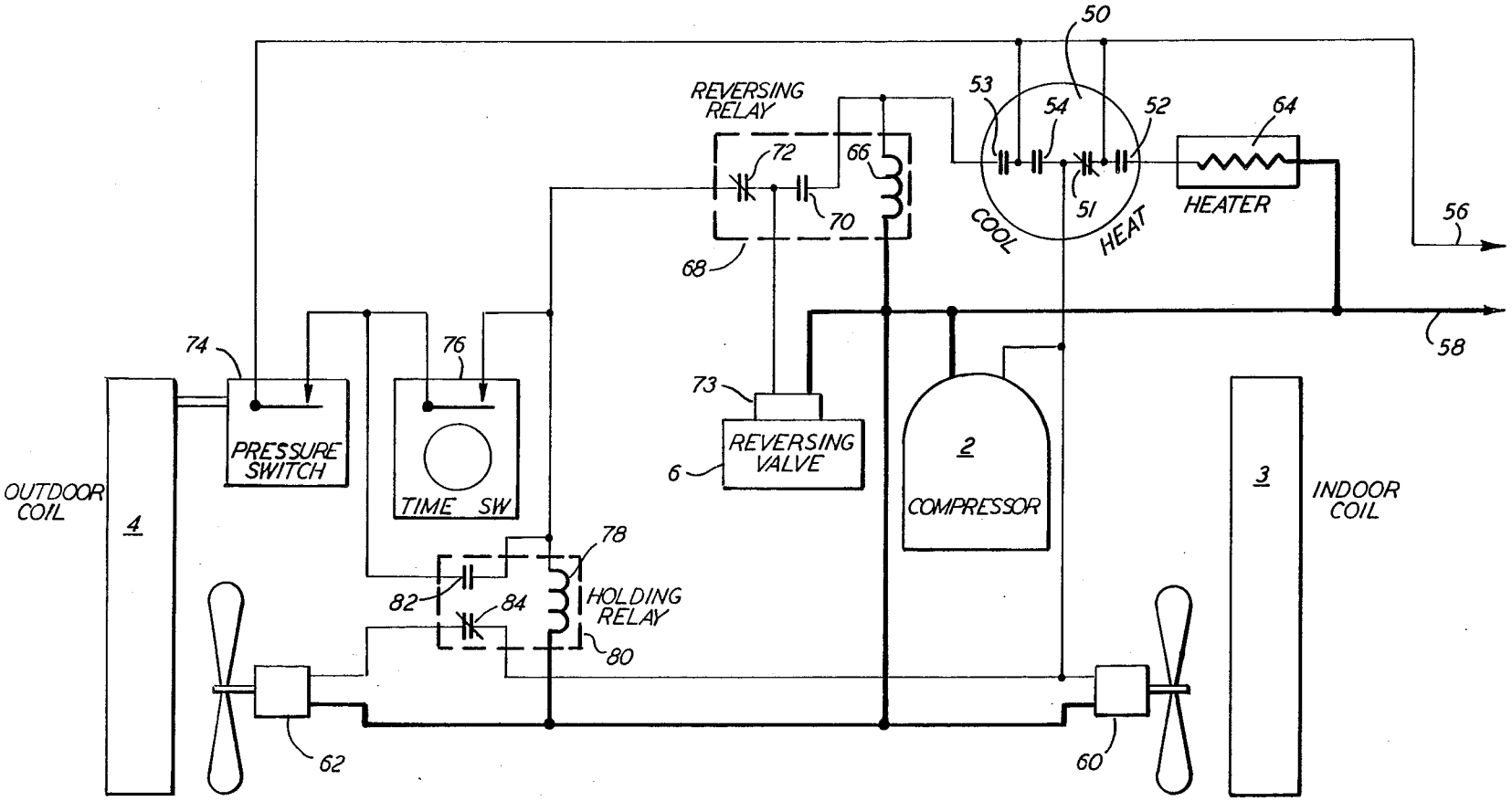
FIG. 6 is a partly schematic, partly diagrammatic illustration of the electrical control system of the heat pump system of the invention.

The electrical control circuit and ancillary components of the heat pump system are shown in FIG. 6, wherein the illustrated positions of the various switch contacts correspond to heating mode operation. Indoor thermostat 50 has two sets of heating contacts 51 and 52 for operating the system in the heating mode, and two sets of cooling contacts 53 and 54 for operation in the cooling mode. Each set of contacts closes in ascending order of the reference numerals as heating or cooling of the conditioned space is required, in accordance with the thermostat setting. Such an arrangement and sequential operation of thermostat contacts is conventional. Contacts 51 are shown in the closed position, connecting hot lead 56 to one side of the motor of compressor 2, the other side being permanently connected to neutral lead 58. Also, fans 60 and 62 are operatively connected to line power when contacts 51 are closed, directing a flow of air over both indoor and outdoor coils 3 and 4. Reversing valve 6 is in the previously described position for heating mode operation, i.e., with the inlet and outlet of compressor 2 connected to the outdoor and indoor coils, respectively, through the reversing valve. If the heat pump is unable to maintain the indoor temperature set on thermostat 50, contacts 52 close and connect auxillary, electric heater 64 across power leads 56 and 58.

When the indoor temperature rises, approaching the level at which thermostat 50 has been set to provide comfort cooling, contacts 53 close, providing power to coil 66 of reversing valve relay 68, closing contacts 70 and opening contacts 72. Power is provided in this manner to solenoid 73 of reversing valve 6 through contacts 70, placing the reversing valve in the cooling mode position, as in FIG. 3. Reversing valve 6 is biased toward the heating mode position, being retained in the cooling mode position only when relay 68 is actuated so that power is connected across solenoid 73.

Contacts 54 close when indoor temperature rises above the level set on thermostat 50 for comfort cooling. Power is thus provided to operate compressor 2 and fans 60 and 62. System operation in the cooling mode is turned on and off as contacts 54 close and open, with contacts 53 remaining closed to retain reversing valve 6 in position for refrigerant flow in the cooling mode. When contacts 53 and 54 open, power is removed from the motor of compressor 2 and fans 60 and 62, as well as from relay coil 66. Switch 70 returns to its normally open position, removing power from solenoid 73 and permitting reversing valve 6 to return to the heating mode position. When the indoor temperature falls, approaching the level at which thermostat 50 has been set to provide comfort heating, contact 51 closes, providing power to the compressor and fans as previously described. During cold weather, when the system is operating in the heating mode, frost will begin to collect on outdoor coil 4 at a specific freezing temperature. In order to maintain the operating efficiency of the system it is necessary to remove the frost at periodic intervals, i.e., to defrost the outdoor coil. Certain of the unique and improved features of the present system are concerned with initiation and termination of, and operation during defrosting cycles.

Dual pressure switch 72, of commercially available design, is responsive to the pressure within outdoor coil 4, closing when the pressure drops to a first, predetermined level and opening when the pressure rises above a second, predetermined level. For example, when R-22 refrigerant is used, the low and high pressure levels for closing and opening switch 72 may be set at 28 psi and 40 psi, respectively. The pressure in the outdoor coil will, of course, be commensurate with a corresponding coil temperature. The low pressure setting of switch 74 is set at one degree warmer than the temperature at which frost forms on outdoor coil 4, and the switch remains closed as long as the temperature is below that level. Pressure switch 72 is connected in series with clock timer switch 74 which closes momentarily at preset time intervals, e.g., every 90 minutes. When both switches 74 and 76 are closed, power is connected across coil 78 of holding relay 80, thereby closing contacts 82 and opening contacts 84. The circuit through contacts 82 bypasses the circuit through timer switch 76, whereby power remains across holding coil 78 after the momentarily closed contacts of switch 76 open.

Power is also provided across solenoid 73 of reversing valve 6, initially through closed contacts 72 and switches 76 and 74; when switch 76 opens, the connection is maintained through contacts 82. This, of course, reverses the position of reversing valve 6, placing the system in the cooling mode of operation although thermostat heating contact 51 remains closed. Also contact 52 remains closed if previously closed. Opening contacts 84 removes power from fan 62 so that it does not operate during defrost cycles.

A defrosting cycle is terminated when switch 74 opens at the high pressure setting, indicating that outdoor coil 4 has increased in temperature to the point that defrosting is complete. Opening of pressure switch 74 removes power from coil 78, thereby deenergizing relay 80 and returning switches 82 and 84 to their normal positions, i.e., open and closed, respectively. Closing of switch 84 restores operation of outdoor fan 62. Power is also removed from solenoid 73, permitting reversing valve 6 to return to its heating mode position. Flow of refrigerant through line 18 and float valve 22 is the same during defrosting cycles as during operation in the cooling mode, i.e., as shown in FIG. 3 and previously described in connection therewith.

In a heat pump system operating with a fixed charge of R-22 refrigerant, for example, preferred low and high set points for the dual pressure switch are 52.39 psi and 68.51 psi to initiate and terminate, respectively, a defrost cycle. Although the pressure of R-22 in a typical heat pump system is 58.78 psi when the refrigerant temperature is 33° F., the actual pressure in the outdoor coil will be 52.39 psi when the outdoor air is at 33° F. This pressure (52.39 psi) corresponds to a refrigerant temperature of 28° F., i.e., 5° lower than that of 33° outside air, indicating that a temperature difference of 5° F. is required to induce heat transfer from the coil fins to the refrigerant inside the coil tubes at the capacity rate of the system. Therefore, the dual pressure switch should be set to close for initiation of a defrost cycle at 52.39 psi, i.e., a pressure 6.39 psi below the pressure of 58.78 psi which corresponds to a refrigerant (R-22) temperature of33° F., i.e., one degree above 32° F. to assure defrosting cycles are in effect before collection of frost has occured.

At a coil temperature of 40° F. the corresponding pressure will be 68.51 psi, which is the preferred setting of the dual pressure switch for opening the contacts to terminate the defrost cycle. That is, while a 6.39 psi pressure difference is required to induce the transfer of heat, as seen above, 11 psi pressure increase is provided to raise the outdoor coil liquid temperature to 40° F., 8° F. higher than freezing temperature of frost on the coil fins, providing heat conduction to the coil liquid, to insure complete defrosting before defrost termination. When the pressure switch is calibrated in temperature it will provide defrost control in systems using any type of refrigerant selected.

As an illustrative example of operation of the invention, a 3-ton heat pump using R-22 refrigerant and operating in the heating mode with outdoor temperature at 20° F. the outdoor coil evaporates the refrigerant at a pressure of 30 psi and vapor temperature of 54.9° F. The compressor draws the vapor through one passage in the reversing valve, compressing it to 186 psi and delivers it through a second passage to the indoor coil at 96.5° F. to effect condensing into a liquid therein. In the process of condensing, the vapor heat is released to air flowing over the coil and leaving at 88° F.

The liquid refrigerant flows from the indoor coil into heating circuit float valve 26, filling its chamber and entering float device 34. This causes float device 34 to lose its buoyancy and sink, whereupon its valve is opened to release 186 psi liquid to the float valve outlet and thence back into the outdoor coil to be re-evaporated under 30 psi. The 165 psi pressure difference across the valve forces liquid flow through the valve seat opening for its immediate return to the outdoor coil as fast as it is condensed. This releases maximum surface area of the indoor coil for condensing. The counterpart result provides the maximum amount of the system liquid refrigerant to the outdoor coil for using the maximum amount of its coil surface for evaporating liquid by heat absorbed from the 20° outdoor air.

Since the pressure in the outdoor coil (30 psi) is below the set-point at which switch 74 closes (58.78 psi), a defrost cycle will be initiated upon closure of switch 76 at the expiration of the preset time interval. Upon initiation of a defrost cycle, reversing valve 6 instantly reverses the system circuit flow direction through both coils. Check valve 28 closes to stop flow through heating float valve 26 while check valve 24 opens to establish the cooling and defrosting circuit through float valve 24. The previously compressed 186 psi vapor in the indoor coil is suddenly released to flow through one passage in the reversing valve, through the compressor, and through a second passage to the outdoor coil under 30 psi pressure. The 186 psi vapor at 96.5° JF. flows momentarily through the compressor faster than the compressor can pump it. In seconds the suction and discharge pressures equalize. Then the compressor begins compressing vapor flow from the indoor coil and compressing it into the outdoor coil at rapidly increasing pressure and temperature.

Refrigerant liquid condensed in the outdoor coil flows immediately through the float valve to lower pressure in the indoor coil. It evaporates immediately, absorbing the 96.5° F. residual heat in the indoor coil. The compressor pumps the hot vapor into the outdoor coil. If there is no frost on the coil its refrigerant temperature will be raised to 40° in 30 seconds. The corresponding 68.51 psi pressure will open pressure switch 74, causing reversing valve 6 to terminate the defrost cycle and restore operation in the heating mode. With a maximum collection of frost on the outdoor coil the defrost cycle may continue for 2 minutes.

At the end of a defrost cycle during 20° F. outdoor temperature the compressor will require a few seconds to reduce the outdoor coil evaporating pressure to 30 psi at 54.9° F. and compress the vapor into the indoor coil at 186 psi whereby the compression process will increase its temperature to 96.5° F.

At the beginning of the following heating cycle the system liquid refrigerant will have been delivered to the indoor coil by the float valve. None will be left in the outdoor coil to be drawn into the compressor. Therefore, an accumulator is not required.

From the foregoing, it may be seen that the invention provides an air-to-air pump having improved heating efficiency through system operation providing minimum length defrost cycles initiated and terminated in immediate response to outdoor coil pressures, and controlled by float valve means maintaining the system charge of liquid refrigerant in the coil serving as an evaporator for maximum heat absorbing efficiency. As an additional consequence, the reversing valve immediately transfers the system liquid to the alternate evaporator to provide, during defrost cycles, a dry outdoor condenser coil, thereby eliminating the requirement for a trap type accumulator.

What is claimed is:

1. An air-to-air heat pump system comprising:

(a) indoor and outdoor heat exchange coils respectively positioned inside and outside a space to which comfort heating and cooling is provided by said system;

(b) a first line connecting said indoor and outdoor coils for flow of refrigerant therethrough in first and second directions during heating and cooling, respectively, of said space;

(c) a refrigerant compressor arranged in said first line;

(d) a reversing valve arranged in said first line and movable between first and second positions to control the direction of flow of refrigerant therethrough;

(e) a second line connecting said indoor and outdoor coils for flow of refrigerant from said indoor to said outdoor coil during heating of said space;

(f) a third line connecting said indoor and outdoor coils for flow of refrigerant from said outdoor to said indoor coil during cooling of said space;

(g) first and second check valves arranged in said second and third lines, respectively, to permit said flow of refrigerant therethrough in only one direction;

(h) first and second float valves connected in series with said first and second check valves in said second and third lines, respectively, for controlling flow of refrigerant into said float valves; and (i) portions of said float valves relatively movable between open and closed positions in response to the level of liquid refrigerant therein for controlled flow of refrigerant out of said float valves.

2. The invention according to claim 1 wherein said float valves are constructed and arranged for movement toward said open and closed positions in response to rise and fall, respectively, in the level of liquid refrigerant therein.

3. The invention according to claim 2 wherein each of said float valves includes a hollow housing having inlet and outlet lines connected thereto for flow of liquid refrigerant into and out of, respectively, said housing.

4. The invention according to claim 3 wherein each of said float valves further includes a hollow float device disposed within said hollow housing, and vertically movable therein, and said relatively movable portions comprise a piston and a valve seat in said outlet line to effect opening and closing of said valves.

5. The invention according to claim 4 wherein said outlet line extends vertically through openings in upper portions of both said housing and said float device, said valve seat being fixedly positioned on the lower end of said outlet line, and said piston being fixedly positioned on the lower portion of said float device, interiorly thereof.

6. The invention according to claim 5 wherein said upper portion of said float device permits flow of liquid refrigerant above a predetermined level within said housing into said float device, the vertical movement of said float device being responsive to the levels of liquid refrigerant within both said housing and said float device.

7. The invention according to claim 1 and further including solenoid means controlling the position of said reversing valve, dual pressure switch means constructed and arranged to close and open in response to first and second, respectively low and high pressures within said outdoor coil, and circuit means wherein both said solenoid means and said pressure switch are so connected that the position of said reversing valve is responsive to the position of said pressure switch means.

8. The invention according to claim 7 and further including a time-operated switch having contacts which are closed and opened at predetermined time intervals connected in said circuit means in series with said pressure switch means, whereby said reversing valve is actuated only when both said pressure switch means and said time-operated switch are closed.

9. The invention according to claim 8 wherein said time-operated switch comprises a pair of contacts which are momentarily closed and then opened at said predetermined time intervals.

10. The invention according to claim 9 wherein said circuit means includes means for retaining said reversing valve in said second position thereof following opening of said time-operated switch until said pressure switch means opens in response to said second pressure.

11. The invention according to claim 10 wherein said retaining means comprises a holding relay having contacts which are closed in response to closing of both said pressure switch means and said time-operated switch, and connected in parallel with said time-operated switch.

12. The invention according to claim 11 wherein said holding relay contacts open in response to opening of said pressure switch means.

13. The invention according to claim 1 wherein said first and second float valves are constructed and arranged to limit flow therethrough to liquid refrigerant.

14. The invention according to claim 13 wherein said float valves are constructed and arranged to permit free flow of liquid refrigerant therethrough at system full capacity and to provide intermittent, throttled flow of liquid refrigerant and valve closing during conditions of reduced liquid flow demand.

15. In a reverse cycle heat pump system:

(a) an indoor coil and an outdoor coil connected in a closed circuit with a compressor;

(b) a reversing valve;

(c) a predetermined, fixed charge of refrigerant;

(d) means for reversing the refrigerant flow to effect alternate evaporation and condensing in said coils;

(e) a first refrigerant flow circuit between said coils including a first float valve and a first check valve connected for one-way free flow of liquid condensate from said outdoor coil to said indoor coil while said indoor coil is evaporating;

(f) a second refrigerant flow circuit between said coils including a second float valve and a second check valve connected for one-way free flow of liquid condensate from said indoor coil to said outdoor coil while said outdoor coil is evaporating; and (g) said float valves being constructed to provide, in the instant of system flow reversal, free flow of liquid refrigerant between said coils thereby providing rapid defrosting of said outdoor coil under low outdoor temperature conditions and permitting elimination of supplemental indoor heating means and the use of an accumulator in said system.

* * * * *